US005809887A

United States Patent [19]

Blackwell et al.

[11] Patent Number: 5,809,887

[45] Date of Patent: Sep. 22, 1998

[54] INK DUCT OF A ROTARY PRINTING PRESS

[75] Inventors: Joseph G. Blackwell, Brenouille; Christian Beyne, Montmagny, both of France

[73] Assignees: Heidelberger Druckmaschinen AG, Heidelberg, Germany; Heidelberg Harris S.A., Montataire Cedex, France

[21] Appl. No.: 972,546

[22] Filed: Nov. 18, 1997

Related U.S. Application Data

[63] Continuation of Ser. No. 651,215, May 22, 1996, abandoned.

[30] Foreign Application Priority Data

May 22, 1995 [FR] France ..... 95 06046

[51] Int. Cl.[6] ..... B41F 31/06

[52] U.S. Cl. ..... 101/350.1; 101/363

[58] Field of Search ..... 101/207, 208, 101/209, 210, 363, 364, 350.1, 350.2, 350.6, 355, 356, 360, 366, 365; 118/259, 262

[56] References Cited

U.S. PATENT DOCUMENTS 1,953,105 4/1934 Flinker .
2,301,535 11/1942 Green .
3,831,517 8/1974 Wagner .

FOREIGN PATENT DOCUMENTS 413 872 12/1966 Switzerland .
646066 11/1950 United Kingdom .
924401 4/1963 United Kingdom .
1 394 423 5/1975 United Kingdom .
2 093 770 9/1982 United Kingdom .
2 278 576 12/1984 United Kingdom .
2 263 438 7/1993 United Kingdom .
2 273 465 6/1994 United Kingdom .

*Primary Examiner*—J. Reed Fisher
*Attorney, Agent, or Firm*—Herbert L. Lerner; Laurence A. Greenberg

[57] ABSTRACT

Ink duct of a rotary printing press, having two side walls between which an ink duct blade is arranged, each of the side walls being formed with an arcuate recess at a front end face thereof for bearing against an ink duct roller of the printing press, includes a deformation device disposed at each of the side walls for modifying a contour thereof defining the respective recess formed therein.

7 Claims, 1 Drawing Sheet

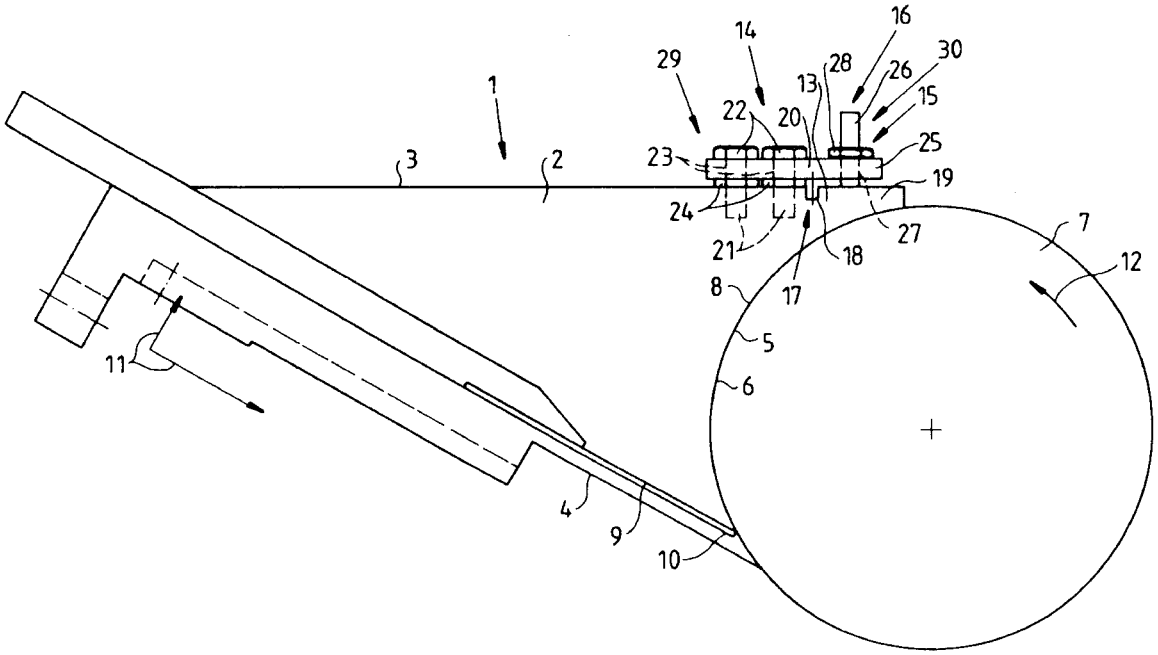
1
2
3
4
5
6
7
8
9
10
11
12
13
14
15
16
17
18
19
20
21
22
23
24
25
26
27
28
29
30

INK DUCT OF A ROTARY PRINTING PRESS

CROSS-REFERENCE TO RELATED APPLICATION

This application is a continuation of application Ser. No. 08/651,215, filed on May 22, 1996, now abandoned.

BACKGROUND OF THE INVENTION

Field of the Invention

The invention relates to an ink duct of a rotary printing press, having two side walls between which an ink duct blade or knife is arranged, each of the side walls being formed with an arcuate recess at a front end surface thereof for bearing against an ink duct roller of the printing press.

Ink ducts of the foregoing general type have been known to include two mutually parallel, spaced-apart side walls having an approximately triangular contour. A side of each of the triangles of each side wall is associated with an inking cylinder, for example an ink duct roller, and is formed with an arcuate recess matching the contour of the circumference of the ink duct roller. An ink duct blade or knife is situated at a lower part of the two side walls and bears with a free front edge thereof against the outer cylindrical surface of the ink duct roller. A felt lining or gasket is arranged between the outer cylindrical or casing surface of the roller and the surface of each of the side walls defining the respective arcuate recess formed therein and is impregnated with wax and/or grease, thereby providing a seal for the ink filling the ink duct. The ink duct roller rotates when in use, and the outer cylindrical or casing surface thereof, which is in contact with the ink, therefore entrains the latter, the ink duct blade forming a thin film of the ink which is directed by other rollers to the printing plate or form of the printing press. The flexibility of the felt provides a good seal between the side walls and the ink duct roller, but the shrinkage, soiling and wear of this felt prevent this seal from being durable. Leaks may therefore appear during use, and give rise to soiling.

The published European Patent Document EP 0 594 536 describes an ink duct in which the side walls are equipped inside the ink duct with sealing plates formed of plastic material and clamped under a preload against the end faces of the ink duct roller. This arrangement is relatively expensive.

SUMMARY OF THE INVENTION

It is accordingly an object of the invention to provide an ink duct of a rotary printing press of the foregoing general type, which has a relatively simple structure and remains optimally sealed throughout a relatively long service life.

With the foregoing and other objects in view, there is provided, in accordance with the invention, an ink duct of a rotary printing press, having two side walls between which an ink duct blade is arranged, each of the side walls being formed with an arcuate recess at a front end face thereof for bearing against an ink duct roller of the printing press, comprising a deformation device disposed at each of the side walls for modifying a contour thereof defining the respective recess formed therein.

In accordance with another feature of the invention, the respective side walls are formed with a weakened region, and each of the deformation devices has a force-applying device assigned to the respective weakened region of each of the side walls.

In accordance with a further feature of the invention, the respective side walls have a substantially triangular shape and are formed with the front end face, an upper end face and a lower end face, respectively, the deformation device being disposed in the vicinity of at least one of the upper and the lower end face thereof.

In accordance with an added feature of the invention, the deformation device is disposed on the upper end face of the respective side wall.

In accordance with an additional feature of the invention, the deformation device is disposed in a corner region of the respective side walls defined by the upper end face and the front end face thereof.

In accordance with yet another feature of the invention, the weakened region of the side wall has a notch formed therein, the notch starting from the respective upper end face of the side wall.

In accordance with yet a further feature of the invention, the deformation device is fixed to the respective side wall on one side of the weakened region and is disposed for applying a force on another side of the weakened region.

In accordance with yet an added feature of the invention, the deformation device has a base body fixed to the upper end face of the side wall and straddling the weakened region, the base body, in vicinity of a free end thereof, having a pressing device for applying a force against the respective side wall.

In accordance with a concomitant feature of the invention, the pressing device is an adjustable compression screw threadedly received in a tapped bore formed in the base body for applying the force against an outer region of a corner of the respective side wall.

In accordance with the invention, no additional seal or gasket is provided between the recess formed in the side walls and the outer cylindrical or casing surface of the ink duct roller, but rather, the recess is defined by a contour of the respective side wall which bears accurately against the casing surface of the roller, the contour accuracy being assured by the deformation device, in accordance with the invention, and also advantageously being able to be readjusted in service. Thus it is impossible for the recess to have too small a contour and to cause the appearance, in the middle region of the recess, of a crescent-shaped gap with the casing surface of the inking roller. Leaks are thus avoided. The opposite effect, namely the middle part of the corresponding recess bearing against the casing surface of the ink duct roller while the end parts of the recess are distant therefrom, that is to say the formation of wedge-shaped spaces, is also prevented in a relatively simple manner by the deformation device according to the invention, because the seal always remains optimal. The deformation device acts upon the material of the side walls and, therefore, the shape thereof varies particularly in the region of the recess so as to form a seal with the ink duct roller. Readjustment of the deformation device makes it possible to correct for separation or spreading tendencies. Readjustment of the deformation device also makes it possible to compensate for wear caused by the rubbing of the end surface of the recess against the casing surface of the ink duct roller throughout the service or operation thereof.

Another particular feature of the invention provides for the deformation device to have a device for applying or exerting a force, that device being associated with a weakened region of the side wall. This weakened region makes it easier to modify or vary the contour of the surface defining the recess and, therefore, the device exerting the force only has to exert a suitably small force in order to reestablish the desired contour. In an alternative embodiment, it is also possible for no weakened region to be provided. This means that the deformation device has to exert a corresponding large force to reestablish the desired contour of the surface defining the recess. The exertion of a force by the deformation device is preferably such that the side wall undergoes no plastic deformation, but only an elastic deformation.

According to another advantageous particular feature of the invention, the side wall, as noted, has a substantially triangular shape is formed with the front end face, an upper end face and a lower end face, the recess being formed in the front end face, and the deformation device being disposed close to or in the vicinity of the upper end face.

The deformation device is preferably situated on the upper end face. In particular, the deformation device is situated in the region of the corner defined by the upper end face and the front or anterior end face.

The weakened region preferably starts from the upper end face of the side wall and is formed by a notch or nick provided in the latter. The expressions "notch or nick" does not mean that this has to be achieved by using a cutting process, but any type of suitable machining operation is possible, such as sawing or the like, to produce the weakening in the material in the corner region. It is necessary only to attain a very slight deformability.

It is moreover advantageous for the deformation device to be fixed to the side wall on one of the sides of the weakened region and for it to exert a force on the other side of this weakened region. Thus, the deformation device is placed on either side of the weakened region, bearing against one side thereof, and exerting a corresponding force on the other side thereof so that overall the corner region is shifted towards the ink duct roller or, upon adjustment for reducing the pressure, is moved away therefrom. The conditions are the same when no weakened region is provided, i.e., when the material of the side wall undergoes deformation between the location at which the deformation device is fastened and an element thereof which exerts a force on the side wall, so that the contour of the surface defining the corresponding recess is modified so that the arc of the recess either narrows or expands.

It is also advantageous for the deformation device to have a base body which is fixed to the upper end face of the side wall, straddling or overlapping the weakened region and being located in the vicinity of or close to a free end thereof, and having a pressing device, particularly an adjustable compression screw threadedly received in a tapped bore formed in the base body and acting upon the side wall, particularly on an outer part of the corner region thereof.

Other features which are considered as characteristic for the invention are set forth in the appended claims.

Although the invention is illustrated and described herein as embodied in an ink duct of a rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single figure of a drawing in which:

BRIEF DESCRIPTION OF THE DRAWING

The FIGURE is a diagrammatic side elevational view of an ink duct of a rotary printing press constructed in accordance with the invention.

DESCRIPTION OF THE PREFERRED EMBODIMENTS

Referring now to the FIGURE of the drawing, there is shown therein an ink duct 1 of an otherwise non-illustrated rotary printing press, having two mutually parallel, spaced-apart side walls 2, only one of which is visible in the figure of the drawing. The side wall 2 includes an upper end face 3, a lower end face 4 and a front end face 5. The front end face 5 is formed with a recess 6 which corresponds to the contour of the circumference of an ink duct roller 7 of the printing press. The end face 5 defining the recess 6 bears sealingly against part of the circumference of the outer cylindrical or casing surface 8 of the ink duct roller 7. The seal thus created prevents the ink in the ink duct 1 from escaping. An ink duct blade or knife 9 having a free front edge 10 cooperating with the casing surface 8 of the ink duct roller 7, is arranged at a lower part of the ink duct 1, between the two side walls 2 thereof. In order to promote the sealing action, it is possible, by means of a non-illustrated conventional adjusting device, to move the ink duct 1 towards the ink duct roller 7 with a suitably desired preloading. This is represented in the figure by arrows 11. The direction of rotation of the ink duct roller 7 represented by the curved arrow 12 is counterclockwise, i.e., an imaginary point lying on the outer cylindrical or casing surface of the roller 7 initially passes the upper part of the tip 13 of the side wall 2 and then travels on towards the ink duct blade 9.

A deformation device 14 is arranged in the aforementioned corner region 13 of the side wall 2 and includes a force-applying device 15 which is equipped with a pressing device 16. A weakened region 17 situated in the corner region 13 of the side wall 2 is formed by a notch or nick 18 starting from the upper end face 3 of the side wall 2. Thus, the outer part 19 of the corner or tip 13 is even more readily deformable than the rest of the side wall 2 in a direction, respectively, towards and away from the ink duct roller 7. This deformation involves a modification in the contour of the recess 6, i.e., it is possible, in this manner, to provide a trouble-free seal with the ink duct roller 7.

The deformation device 14 has a preferably parallelepipedal body 20 which is screwed onto the upper end face 3 of the side wall 2. In this regard, two mutually spaced-apart tapped bores 21 are formed in the upper end face 3, on the side 29 of the weakened region 17 which faces away from the ink duct cylinder 7. Two machine or assembly screws 22 screwed into these tapped bores 21 pass through corresponding through-holes 23 formed in the base body 20, and thereby, with washers 24 interposed, clamp the base body 20 to the upper end face 3. The base body 20 overlaps the weakened region 17 like a bridge, and the pressing device 16 is located close to the free end 25 of the base body 20 which faces towards the ink duct roller 7. This pressing device 16 is formed of a screw 26 threadedly secured in a tapped bore 27 formed in the base body 20. When the screw 26 is screwed into the tapped bore 27, the end of the screw 26 presses against an outer part 19 of the corner region or tip 13 of the side wall 2, thereby deforming the side wall 2 in the vicinity of the recess 6, i.e., the contour of the side wall 2 defining the recess 6 is accordingly modified or varied. When the compression screw 26 is loosened, the arcuate contour of the side wall 2 defining the recess 6 is permitted to expand. The compression screw 26 may be fixed by means of a locknut 28, after the pressing device 16 has been adjusted.

We claim:

1. Ink duct of a rotary printing press, comprising:

two fixedly mounted side walls each having a front end face and an upper end face;

an ink duct blade disposed between said side walls, each of said side walls being formed with an arcuate recess at said front end face thereof for bearing against an ink duct roller of a printing press;

a deformation device disposed at each of said side walls for modifying a contour thereof defining said respective recess formed therein;

each of said side walls being formed with a weakened region, and each of said deformation devices having a force-applying device assigned to said weakened region of each of said side walls;

said weakened region of each of said side walls having a notch formed therein for assisting in adjusting said recess of said side walls, said notch starting from said respective upper end face of each of said side walls; and said upper end face having an outer part, and said deformation device bridging said weakened region for exerting a force on said outer part.

2. Ink duct according to claim 1, wherein said respective side walls have a substantially triangular shape and are formed with a lower end face, respectively, said deformation device being disposed in the vicinity of at least one of said upper and said lower end face thereof.

3. Ink duct according to claim 2, wherein said deformation device is disposed on said upper end face of said respective side walls.

4. Ink duct according to claim 2, wherein said deformation device is disposed in a corner region of said respective side walls defined by said upper end face and said front end face thereof.

5. Ink duct according to claim 1, wherein said deformation device is fixed to said respective side walls on one side of said weakened region and is disposed for applying a force on another side of said weakened region.

6. Ink duct according to claim 2, wherein said deformation device has a base body fixed to said upper end face of each of said side walls and straddling said weakened region, said base body, in vicinity of a free end thereof, having a pressing device for applying a force against said respective side walls.

7. Ink duct according to claim 6, wherein said pressing device is an adjustable compression screw threadedly received in a tapped bore formed in said base body for applying the force against an outer region of a corner of said respective side walls.

* * * * *